US009438986B2

(12) United States Patent
Tang

(10) Patent No.: US 9,438,986 B2
(45) Date of Patent: Sep. 6, 2016

(54) IN-EAR HEADPHONE WITH SOUND PICK-UP CAPABILITY

(71) Applicant: Qi Tang, Shenzhen (CN)

(72) Inventor: Qi Tang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 63 days.

(21) Appl. No.: 14/324,280

(22) Filed: Jul. 7, 2014

(65) Prior Publication Data

US 2015/0030195 A1 Jan. 29, 2015

(30) Foreign Application Priority Data

Jul. 25, 2013 (CN) ..... 2013 1 0315110

(51) Int. Cl.

| | |
|---|---|
| ***H04R 1/10*** | (2006.01) |
| *H04R 17/00* | (2006.01) |
| *H04R 17/02* | (2006.01) |
| *H04R 25/00* | (2006.01) |

(52) U.S. Cl.

CPC ..... *H04R 1/1091* (2013.01); *H04R 1/1016* (2013.01); *H04R 17/00* (2013.01); *H04R 17/025* (2013.01); *H04R 25/606* (2013.01)

(58) Field of Classification Search

CPC H04R 1/1016; H04R 1/1058; H04R 1/1091; H04R 25/652; H04R 25/658; H04R 25/656; H04R 1/02; H04R 2499/11; H04R 1/028; H04R 25/356; H04R 25/70; H04R 2225/43; H04R 25/50; B41J 2/14233; H01L 41/083; H01L 41/1871

USPC ..... 381/328, 334, 321–322, 380; 310/311

See application file for complete search history.

(56) References Cited

U.S. PATENT DOCUMENTS

| | | | | |
|---|---|---|---|---|
| 5,298,692 A * | 3/1994 | Ikeda | H04R 1/1016 | 181/135 |
| 2006/0159297 A1* | 7/2006 | Wirola | H04R 1/1016 | 381/328 |
| 2008/0205679 A1* | 8/2008 | Darbut | H04R 25/554 | 381/328 |
| 2013/0221804 A1* | 8/2013 | Ichikawa | G01C 19/5621 | 310/323.21 |

* cited by examiner

*Primary Examiner* — Rasha Al Aubaidi

(74) *Attorney, Agent, or Firm* — Na Xu; IPro, PLLC

(57) ABSTRACT

An in-ear headphone with sound pick-up capability is disclosed. The in-ear headphone includes a pair of ear pieces. Each of the ear pieces includes an ear tip, an audio receiver and an acoustic-to-electric transducer. The ear tip is capable of being inserted into an ear canal. The audio receiver is configured for recovering sound signals from audio electrical signals and transmitting the sounds signals to the ear canal via the ear tip. The acoustic-to-electric transducer is disposed on the ear tip, and configured for sensing vibration of an inner wall of the ear canal and generating an electrical signal in accordance with the vibration.

17 Claims, 5 Drawing Sheets

IN-EAR HEADPHONE WITH SOUND PICK-UP CAPABILITY

FIELD OF THE DISCLOSURE

The present disclosure generally relates to headphones, and more particularly, to an in-ear headphone with sound pick-up capability.

BACKGROUND

Headphones are widely used in modern electronic devices for providing audible sounds for users. An in-ear headphone (namely, earphone or ear-fitting headphone) is one type of headphones, which includes a pair of earpieces that can be inserted into user's ear canals. A headphone may be combined with a microphone to form an audio headset. The microphone serves as an acoustic sensing device, and normally includes an acoustic-to-electric transducer for converting sound waves like voices of the user into electrical signals that can then be amplified, transmitted, and output.

However, in a related audio headset, the microphone is normally somewhat distant from the user's mouth, thus the user may have to move the microphone close to his or her mouth in order to improve a signal-to-noise ratio of the microphone, which brings inconvenience to the user. Moreover, the microphone is exposed in the air, and thus ambient noise may be unavoidably picked up by the microphone. Therefore, a sound recognition of the microphone cannot satisfy the user's expectation or requirements.

Accordingly, the present disclosure provides an improved in-ear headphone to overcome the aforesaid problems.

BRIEF DESCRIPTION OF THE DRAWINGS

Many aspects of the embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and embodiments thereof.

Figure 1:
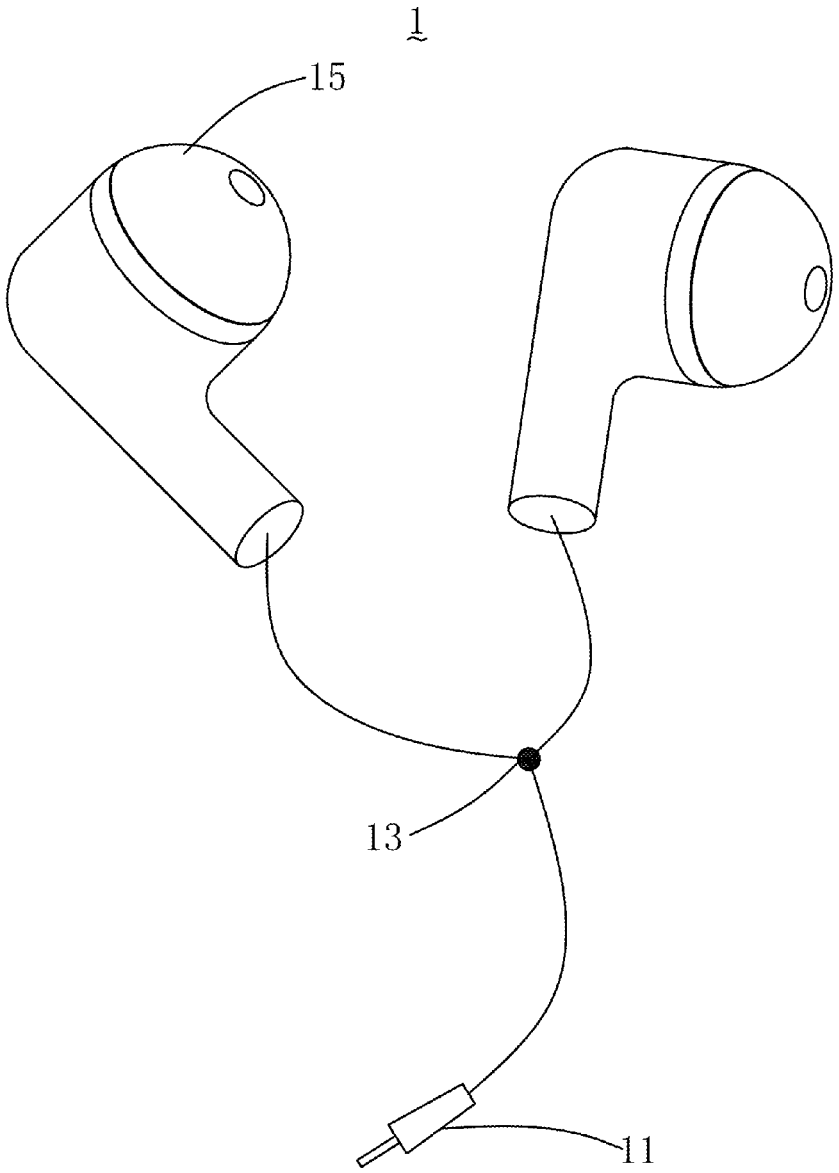
FIG. 1 is an isometric view of an in-ear headphone according to an exemplary embodiment of the present disclosure, the in-ear headphone including earpieces having an acoustic-to-electric transducer.

FIG. 1 is an isometric view of an in-ear headphone according to an exemplary embodiment of the present disclosure. The in-ear headphone 1 is also known as an earphone, and includes a headphone connector 11, a headphone wire 13 and a pair of earpieces 15. The headphone connector 11 is plugged into an audio source (not shown)

such as a mobile phone, a portable media player, or other electronic devices, and is configured to receive audio electrical signals from the audio source. In fact, the headphone connector 11 may also be a wireless transmission element like a Bluetooth unit. The pair of earpieces 15 is electrically connected to the headphone connector 11 via the headphone wire 13. In this embodiment, the headphone wire 13 is exposed outside of the earpiece 15, and optionally, the wire 13 may be received inside of the earpiece 15. When the in-ear headphone 1 is used by a user, one of the earpieces 15 can be inserted into a left ear canal of the user, and the other one of the earpieces 16 can be inserted into a right ear canal of the user. It is understood that this embodiment provides a stereo headphone, and the disclosure is also applicable to a mono one, i.e. the headphone includes only one earpiece.

Figure 2:
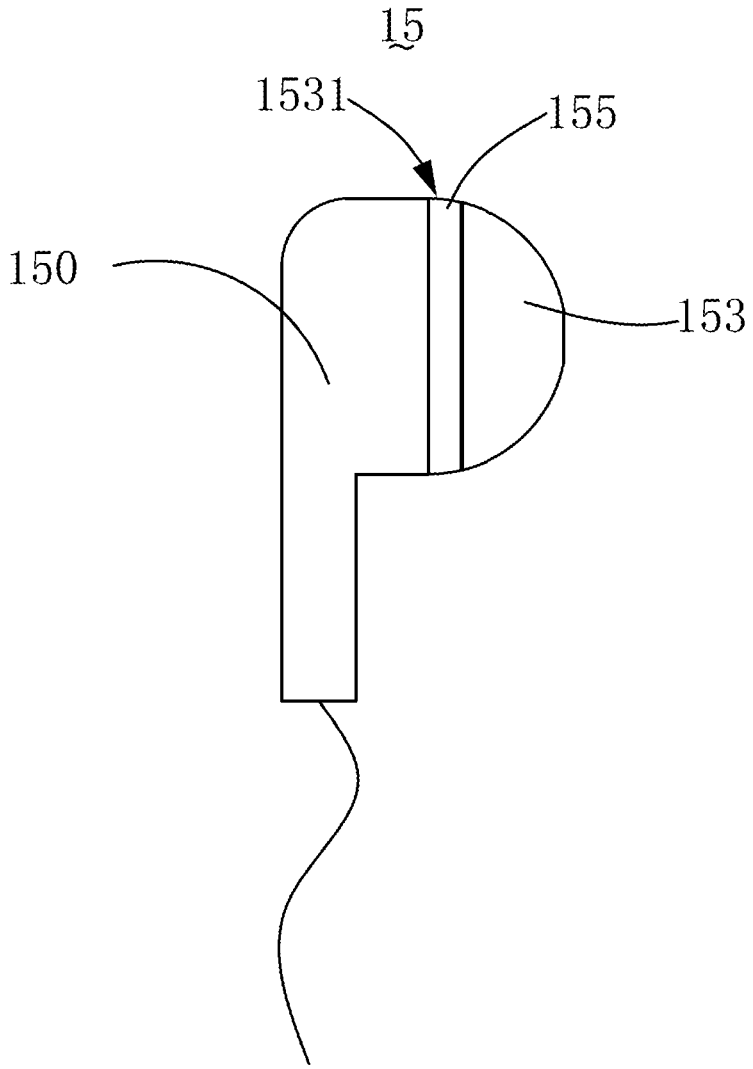
FIG. 2 is a planar view of the earpiece of the in-ear headphone of FIG. 1.
Figure 3:
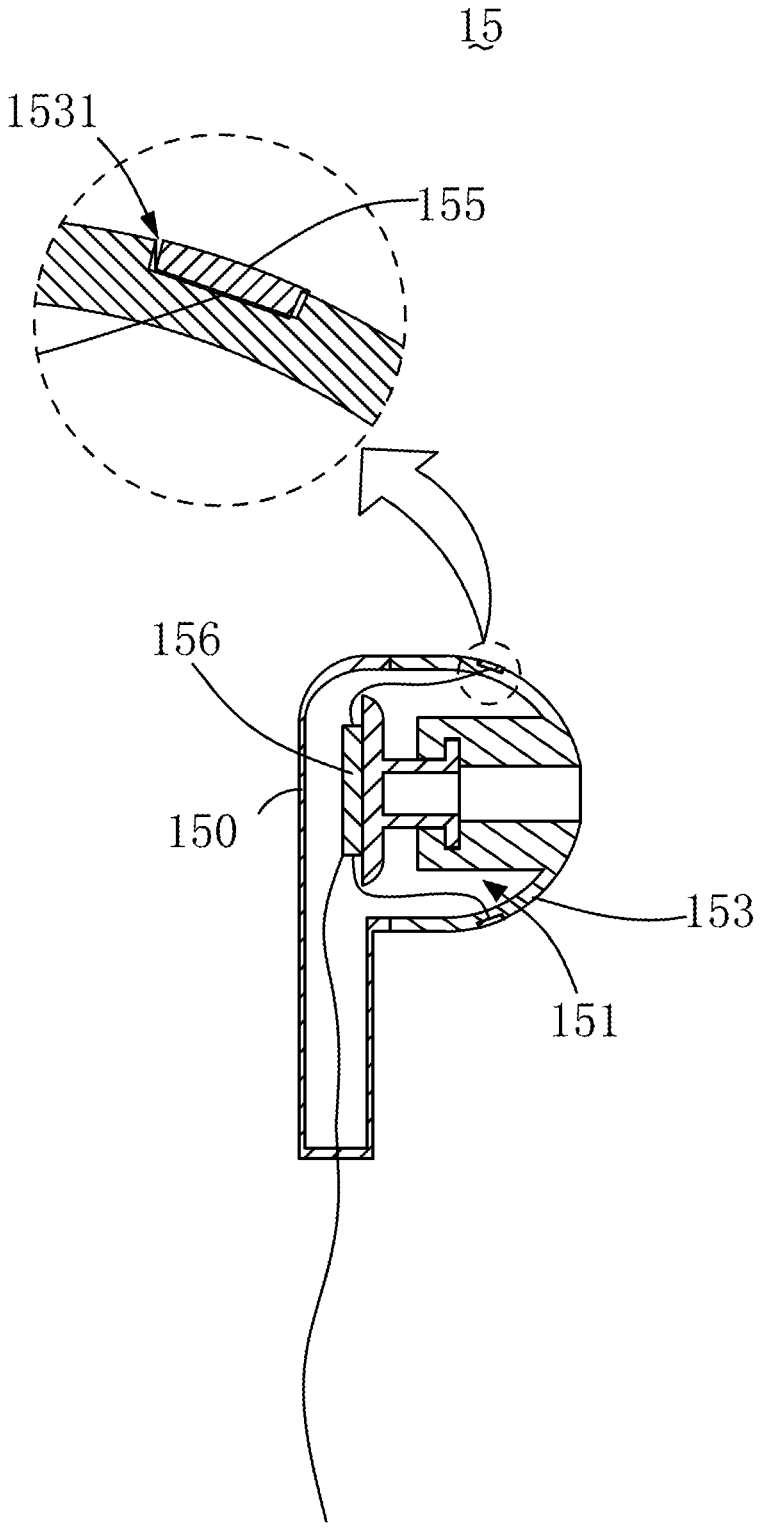
FIG. 3 is a cross-sectional view of the earpiece of the in-ear headphone of FIG. 1.

Referring also to FIGS. 2-3, the earpiece 15 of the in-ear headphone 1 includes a housing 150, an audio receiver 151, an ear tip 153, an acoustic-to-electric transducer 155, and a preamplifier module 156.

The audio receiver 151 is an electro-acoustic device serving as a listening part of the in-ear headphone 1 for performing sound reproduction under a standard non-leakage condition. The audio receiver 151 is a main component for recovering the sound signals from the audio electrical signals, and the audio receiver 151 may further transmit the sound signals to the user's ear canal via the ear tip 153.

The ear tip 153 may be a plastic component, for example, the ear tip 153 may be made of silicone material. The ear tip 153 is designed to have an outer profile substantially matching an internal profile of an ear canal, so as to enable the ear tip 153 to be inserted into the ear canal of the user. In addition, the ear tip 153 has a configuration to enable an external surface thereof to abut on an inner wall of the ear canal when the ear tip 153 is inserted into the ear canal of the user.

The ear tip 153 defines an accommodating space which opens at both ends thereof, the audio receiver 151 may be received in the accommodating space. One end of the ear tip 153 is configured as a connecting end, which is fixed to an opening (not shown) of the housing 150 and surrounds an end of the audio receiver 151; the other end of the ear tip 153 is communicated with the ear canal of the user to enable the sound signals provided by the audio receiver 151 to be transmitted to the user's ear canal.

The acoustic-to-electric transducer 155 is disposed on the ear tip 153, and is configured for sensing vibration of the inner wall of the ear canal when the user speaks, so as to pick up sounds made by the user, which is also called bone conduction. Moreover, the acoustic-to-electric transducer 155 can also generate an electrical signal corresponding to the vibration.

In one embodiment, the acoustic-to-electric transducer 155 has a ring-shaped structure and is disposed at an external surface of the ear tip 153. To receive the acoustic-to-electric transducer 155, an annular groove 1531 is correspondingly formed at the external surface of the ear tip 153, as illustrated in FIG. 2. In particular, the annular groove 1531 may have a depth substantially equal to a thickness of the acoustic-to-electric transducer 155. As such, an external surface of acoustic-to-electric transducer 155 is coplanar with the external surface of the ear tip 153, such that the external surface of the acoustic-to-electric transducer 155 can also abut against the inner wall of the ear canal to sense the vibration thereof upon the condition that the ear tip 153 is inserted into the ear canal. Moreover, with this configuration, the acoustic-to-electric transducer 155 can also prevent air flow from leaking from the ear canal.

Figure 4:
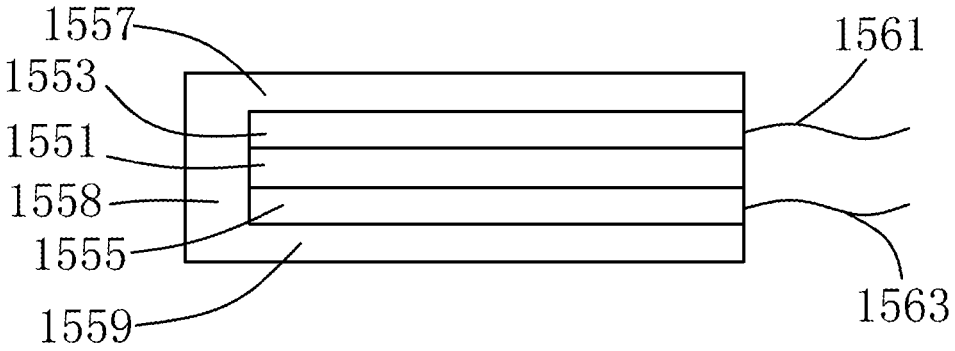
FIG. 4 is a cross-sectional view of acoustic-to-electric transducer of the earpiece of the in-ear headphone of FIG. 1.

FIG. 4 is a cross-sectional view of acoustic-to-electric transducer 155 of the earpiece 15. The acoustic-to-electric transducer 155 may be a piezoelectric film (for example, a piezoelectric ceramic film) with a multi-layer structure. The acoustic-to-electric transducer 155 includes a piezoelectric film layer 1551, a first electrode layer 1553, a second electrode layer 1555, a first shielding layer 1557 and a second shielding layer 1559. The first shielding layer 1557, the first electrode layer 1553, the piezoelectric film layer 1551, the second electrode layer 1557 and the second shielding layer 1559 are arranged in a sequence as shown in FIG. 4.

The piezoelectric film layer 1551 is a piezoelectric component made by piezoelectric ceramic. The piezoelectric film layer 1551 may provide piezoelectric effect when a pressure is perpendicularly applied thereto, and accordingly piezoelectric charges are induced and accumulated at two opposite surfaces (namely, a top surface and a bottom surface thereof as illustrated in FIG. 4) of the piezoelectric film layer 1551. Since the acoustic-to-electric transducer 155 abuts against the inner wall of the ear canal, the pressure is typically generated in responsive to vibration of the inner wall of the ear canal. Furthermore, due to the piezoelectric charges, an electrical signal corresponding to the vibration is generated at the piezoelectric film layer 1551, and an amplitude of the electrical signal is in proportion to a magnitude of the vibration.

The first electrode layer 1553 and the second electrode layer 1555 are respectively formed at opposite sides of the piezoelectric film layer 1551 to sandwich and electrically contact the piezoelectric film layer 1551 therebetween. The first electrode layer 1553 is further electrically connected to the preamplifier module 156 via a first connecting wire 1561, and the second electrode layer 1555 is further electrically connected to the preamplifier module 156 via a second connecting wire 1563. The first electrode layer 1553 and the second electrode layer 1555 may output the electrical signal generated by the piezoelectric film layer 1551 to the preamplifier module 156 for pre-amplification.

The first shielding layer 1557 and the second shielding layer 1559 are respectively formed adjacent to the first electrode layer 1553 and the second electrode layer 1555. The first shielding layer 1557 and the second shielding layer 1559 can cooperatively protect and insulate the piezoelectric film layer 1551. In particular, the first shielding layer 1557 and the second shielding layer 1559 may be configured to cooperatively form a one-piece U-shape structure, that is, a connection portion 1558 may be formed to connect corresponding ends of the first shielding layer 1557 and the second shielding layer 1559, as shown in FIG. 4.

In particular, a total thickness of the acoustic-to-electric transducer 155 may be in a range from 95 μm (micrometers) to 105 μm, and preferably, 100 μm. Furthermore, because the electrical signal is generated according to the pressure applied to the acoustic-to-electric transducer 155, to ensure a signal-to-noise ratio (SNR) of the electrical signal, the acoustic-to-electric transducer 155 may be designed to have a large area as possible.

In operation, the ear tip 153 is inserted into the ear canal of the user, with the external surface of the acoustic-to-electric transducer 155 abutting on an inner wall of the ear canal. The audio receiver 151 converts the audio electrical signals received from the headphone connector 11 into sound signals, and transmits the sound signals to the ear canal of the user via the ear tip 153.

When the user speaks, the inner wall of the ear canal vibrates corresponding to sound made by the user, the vibration of the inner wall of the ear canal is sensed by the acoustic-to-electric transducer 155. Due to piezoelectric characteristics of the piezoelectric film layer 1551, piezoelectric effect occurs on the piezoelectric film layer 1551 of the acoustic-to-electric transducer 155, and an electrical signal corresponding to vibration of the inner wall of the ear canal is generated. In other words, the sound of the user can be picked up by the acoustic-to-electric transducer 155 in a form of the electrical signal. The electrical signal is then transmitted to the preamplifier module 156, and the preamplifier module 156 performs a pre-amplification on the piezoelectric signal. Thereafter, the electrical signal can be output for signal processing.

In the in-ear headphone 1 as provided in the present disclosure, an acoustic-to-electric transducer 155 is disposed on the ear tip 153 of the ear piece 15. With this configuration, the acoustic-to-electric transducer 155 can be inserted into the ear canal of the user accompanying with the ear tip 153, and thus can sense the vibration of the inner wall of the ear canal when the user speaks, so as to pick up the sound made by the user. With this sound pick-up capability, it is unnecessary for the user to hold a microphone close to his or her mouth, and thus operation convenience of in-ear headphone 1 is improved. Furthermore, the acoustic-to-electric transducer 155 is not exposed in the air since it is inserted into the ear canal, which can prevent the acoustic-to-electric transducer 155 from picking up ambient noise, thereby improving the sound recognition.

Figure 5:
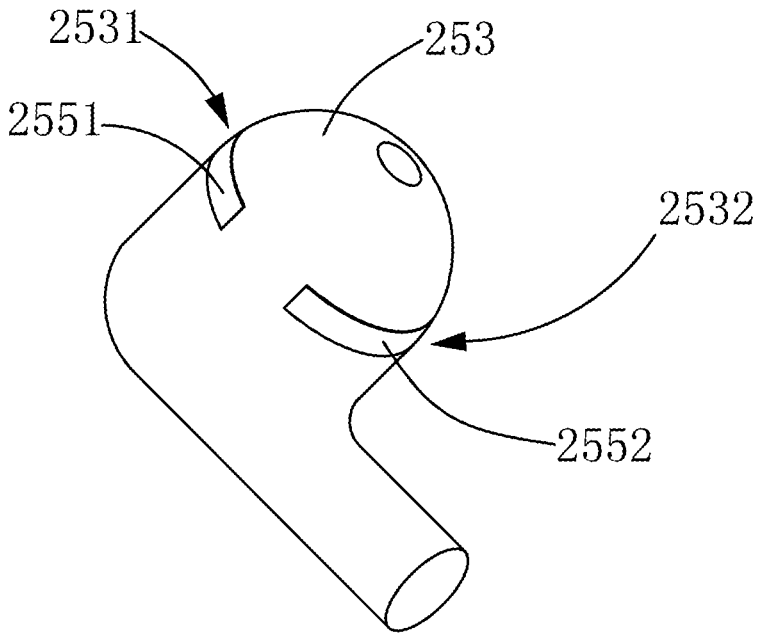
FIG. 5 is a cross-sectional view of an earpiece of an in-ear headphone according to another exemplary embodiment of the present disclosure.

FIG. 5 is a cross-sectional view of an earpiece of an in-ear headphone according to an alternative embodiment of the present disclosure. The in-ear headphone in the alternative embodiment is similar to the above-described in-ear headphone 1, but differs in that an acoustic-to-electric transducer of an earpiece 25 of the in-ear headphone 200 includes at least two transducer units 2531 and 2532.

Specifically, the acoustic-to-electric transducer of an earpiece 25 includes a first transducer unit 2551 and a second transducer unit 2552. Both of the first transducer unit 2551 and the second transducer unit 2552 are in an arc shape. Correspondingly, a first sub-groove 2531 and a second sub-groove 2532 are formed at an ear tip 253 of earpiece 25 to receive the first transducer unit 2551 and the second transducer unit 2552. The transducer unit 2551 and the second transducer unit 2552 are both piezoelectric film with a configuration substantially the same as illustrated in FIG. 4. It is noted that in other embodiment, the transducer units 2551 may alternatively have other shapes.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An in-ear headphone, comprising:

an earpiece comprising:

an ear tip for being inserted into an ear canal;

an audio receiver for generating sounds from audio electrical signals and transmitting the sounds to the ear canal via the ear tip; and an acoustic-to-electric transducer disposed on an external surface of the ear tip, a groove formed on the external surface of the ear tip and the acoustic-to-electric transducer received in the groove, an external surface of acoustic-to-electric transducer coplanar with the external surface of the ear tip, the acoustic-to-electric transducer being configured for sensing vibration of an inner wall of the ear canal and generating electrical signals corresponding to the vibration.

2. The in-ear headphone of claim 1, wherein the acoustic-to-electric transducer is a piezoelectric film.

3. The in-ear headphone of claim 2, wherein the acoustic-to-electric transducer has a ring-shaped structure and the groove is an annular groove.

4. The in-ear headphone of claim 2, wherein the acoustic-to-electric transducer comprises at least two transducer units, and the groove comprises at least two sub-grooves for respectively receiving the at least two transducer units.

5. The in-ear headphone of claim 2, wherein a total thickness of the acoustic-to-electric transducer is in a range from 95 micrometers to 105 micrometers.

6. The in-ear headphone of claim 1, wherein the acoustic-to-electric transducer comprises a piezoelectric film layer, a first electrode layer and a second electrode layer, the first electrode layer and the second electrode layer are respectively disposed at opposite sides of piezoelectric film layer and electrically contact the piezoelectric film layer.

7. The in-ear headphone of claim 6, wherein the acoustic-to-electric transducer further comprises a first shielding layer and a second shielding layer, the first shielding layer and the second shielding layer are respectively disposed adjacent to the first electrode layer and the second electrode layer.

8. The in-ear headphone of claim 7, wherein the first shielding layer and the second shielding layer cooperatively form a one-piece U-shape structure.

9. The in-ear headphone of claim 6, wherein the ear piece further comprises a preamplifier module, the first electrode layer and the second electrode layer are electrically connected to the preamplifier module via a first connecting wire and a second connecting wire respectively.

10. The in-ear headphone of claim 1, further comprising a headphone connector for receiving the audio electrical signal from an audio source, and a headphone wire for electrically connecting the pair of ear pieces with the headphone connector.

11. An earphone, comprising:

an ear piece, comprising:

an audio receiver for converting audio electrical signals into sounds;

an ear tip for being communicated with an ear canal; and an acoustic-to-electric transducer disposed on an external surface of the ear tip for providing sound pick-up capability by sensing vibration of an inner wall of the ear canal and generating an electrical signal in accordance with the vibration, a groove formed on the external surface of the ear tip, the acoustic-to-electric transducer received in the groove, and an external surface of acoustic-to-electric transducer level with that of the ear tip.

12. The earphone of claim 11, wherein the acoustic-to-electric transducer is a piezoelectric film.

13. The earphone of claim 12, wherein the acoustic-to-electric transducer has a ring-shaped structure and the groove is an annular groove.

14. The earphone of claim 12, wherein the acoustic-to-electric transducer comprises at least two transducer units, and the groove comprises at least two sub-grooves for respectively receiving the at least two transducer units.

15. The earphone of claim 11, wherein the acoustic-to-electric transducer comprises a piezoelectric film layer, a first electrode layer and a second electrode layer, the first electrode layer and the second electrode layer are respectively disposed at opposite sides of piezoelectric film layer and electrically contact the piezoelectric film layer.

16. The earphone of claim 15, wherein the acoustic-to-electric transducer further comprises a first shielding layer and a second shielding layer, the first shielding layer and the second shielding layer are respectively disposed adjacent to the first electrode layer and the second electrode layer.

17. The earphone of claim 15, wherein the ear piece further comprises a preamplifier module, the first electrode layer and the second electrode layer are electrically connected to the preamplifier module via a first connecting wire and a second connecting wire respectively.

* * * * *